United States Patent [19]

Bowyer

[11] 4,427,064

[45] Jan. 24, 1984

[54] WIRE LINE NO-BLOW TOOL

[75] Inventor: Michael L. Bowyer, Aberdeen, Scotland

[73] Assignee: Baker International Corporation, Orange, Calif.

[21] Appl. No.: 307,910

[22] Filed: Oct. 2, 1981

[51] Int. Cl.[3] ..... E21B 23/00

[52] U.S. Cl. ..... 166/217; 166/178

[58] Field of Search ..... 166/209, 217, 208, 178

[56] References Cited

U.S. PATENT DOCUMENTS

| | | | |
|---|---|---|---|
| 2,358,466 | 9/1944 | Miller | 166/178 |
| 2,884,073 | 4/1951 | Bostock et al. | 166/217 |
| 3,023,811 | 3/1962 | Green | 166/217 |
| 3,191,677 | 6/1965 | Kinley | 166/209 |
| 3,294,173 | 12/1966 | Hodges | 166/217 |
| 3,356,141 | 12/1967 | Kline | 166/217 |
| 3,860,067 | 1/1975 | Rodgers | 166/217 |

*Primary Examiner*—William F. Pate, III

*Attorney, Agent, or Firm*—Norvell & Associates

[57] ABSTRACT

No-blow tool for braking rapid upward movement of a pulling tool and the device being retrieved caused by sudden upward fluid flow. The no-blow tool is assembled as part of a wire line tool assembly below jars and above the pulling tool. The no-blow tool includes three telescoping members, the lowest of which is secured to the pulling tool. Rapid upward movement of the pulling tool and the lowest telescoping member relative to the intermediate telescoping member cams serated slips radially outwardly to grip a well conduit, thereby braking the upward movement. A shearable connection between the upper and intermediate telescoping members permits jarring forces to be transmitted downwardly through the tool, without interference from the slip system.

5 Claims, 4 Drawing Figures

WIRE LINE NO-BLOW TOOL

BACKGROUND OF THE INVENTION

1. Field of the Invention

The invention relates to a no-blow tool which automatically anchors itself and associated tools to a conduit of a oil or gas well in response to rapid upward movement of a flow control or other device below the no-blow tool, thereby preventing such device from being blown upwardly within the well by a fluid pressure differential.

2. Description of the Prior Art

Wire line pulling tools or fishing tools are employed to remove from an oil or gas well, any number of tools, such as a separation sleeve, a plug, or other flow control devices. Often, there is a pressure differential across the flow control device, which is locked in place within the well casing. As the flow control device is unlocked from the casing during the pulling process and removed from the seal bore, the device can be accelerated violently upwardly as the fluid is suddenly permitted to flow to equalize the pressure differential. If a flow control device and the pulling tool and associated wire line string are blown upwardly in such a situation, the wire line will often be kinked and broken, thereby necessitating a second retrieval operation.

There is a need therefore, for a no-blow tool which will automatically anchor itself and an associated wire line string in response to rapid upward movement of a pulling tool run below the no-blow tool. Existing slip anchors are not adapted for such use.

If, for some reason, it is impossible to remove the flow control device to be retrieved, a conventional pulling tool can be released therefrom by downward jarring, which shears the connection between the pulling tool and the flow control device. It is desirable therefore that a no-blow tool be capable of transmitting jarring forces while it is anchored against the casing.

SUMMARY OF THE INVENTION

A no-blow tool according to the invention is assembled in a wire line assembly of tools below mechanical jars and above a pulling tool. The no-blow tool includes an annular housing carrying serrated slips which are radially expandable outwardly into gripping engagement with the casing in response to upward movement of the pulling tool, to brake such upward movement. An inner mandrel is slidably mounted within the annular housing, and extends downwardly therefrom for attachment to the pulling tool. The mandrel includes an upwardly and inwardly tapering conical camming surface for camming the serrated slips outwardly as the mandrel moves upwardly relative to the housing.

A release mandrel is also slidably mounted within the housing, and extends upwardly therefrom for attachment to the wire line string, including the mechanical jars. The upper release mandrel is normally prevented from telescoping axial sliding within the housing by a plurality of shear pins. When necessary to jar the pulling tool downwardly, the pins are shearable to permit the upward release mandrel to contact the lower mandrel within the annular housing. Hence, downward jarring can be transmitted from the jars to the pulling tool without interferrence from the intermediate annular housing and the associated serrated slips.

DESCRIPTION OF THE PREFERRED EMBODIMENTS

Figure 1A:
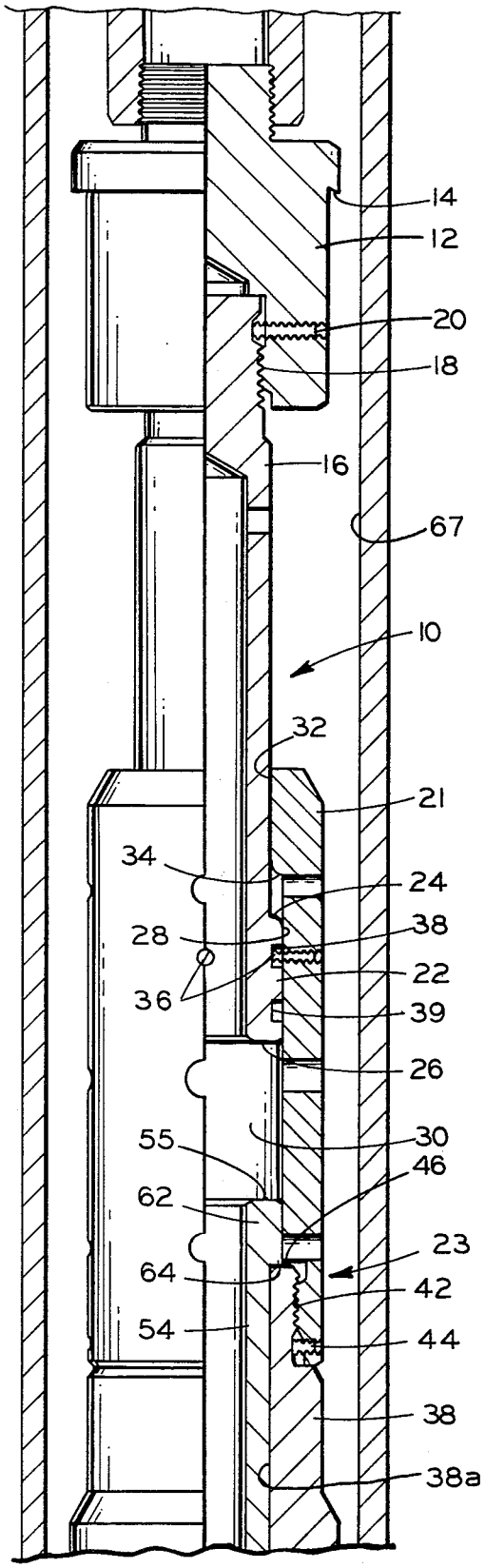
FIGS. 1A and 1B collectively constitute an elevational view, in half section, of a no-blow tool embodying the invention, illustrated in the running position, FIG. 1B being a lower continuation FIG. 1A.

In the drawing, the no-blow tool 10 embodying the invention is shown in position within a well conduit such as casing, made up as part of a string of wire line tools.

The no-blow tool is typically connected to mechanical jars by means of the threaded top sub 12. The top sub 12 includes a fishing neck 14. A downwardly extending release mandrel 16 is attached to the lower end of the top sub 12 by a threaded connection 18. A set screw 20 maintains the threaded connection 18.

The lower portion of the release mandrel 16 is telescopingly disposed within the upper housing 12 of an annular housing assembly 23. The release mandrel 16 terminates in a relatively large outside diameter hammer 22 defined by an upwardly facing annular face 24, and a downwardly facing annular face 26. The outer cylindrical surface 28 of the hammer 22 is sized for an axially sliding fit within the inside cylindrical surface 30 of the upper housing 21. The upper opening of the annular upper housing 21 is defined by a relatively small inside diameter cylindrical surface 32, for sliding engagement with the release mandrel 16. A downwardly facing annular shoulder 34 provides a transition between the cylindrical surface 32 and the larger diameter cylindrical surface 30, and provides a striking surface for the hammer 22.

In the running position of the no-blow tool 10, the release mandrel 16 is fixed to the upper housing 21 by a plurality of circumferentially spaced shear pins 36. During setup of the tool, the shear pins 36 may be set in either an upper annular groove 38, or a lower annular groove 39, both formed in the outside cylindrical surface 28 of the hammer 22. If the no-blow tool 10 is set up with the shear pins 36 engaging the lower groove 39, the hammer face 24 abuts the annular shoulder 34. Hence, the shear pins 36 can be sheared only by a downward movement of the release mandrel 16 relative to the housing 23.

The outer annular housing 23 includes the upper housing 21, a connector sub 38, and a slip ring 40. The connector sub 38 is secured to the lower end of the upper housing 21 by means of a threaded connection 42, including a set screw 44. The connector sub 38 provides a transition between the upper housing 21 and the relatively larger diameter slip ring 40. The inside diameter of the connector sub 38 is less than the inside diameter of the upper housing 21. Hence, the upper end of the connector sub 38 is defined by an exposed, upwardly facing annular surface 46.

The slip ring 40 is secured to the lower end of the connector sub 38 by means of a threaded connection 48, including a set screw 50. A plurality of circumferentially spaced, axial slots 51 are formed through the slip ring 40, to respectively receive serrated slips 52.

In addition to the outer annular housing 23 and the telescoping release mandrel 16, a third telescoping assembly comprises an inner mandrel 54, a cone 56, a guide ring 58, and a bottom sub 60. The inner mandrel 54 is telescopingly disposed within the outer housing assembly 23, in sliding engagement with the inside cylindrical surface of the connector sub 38. Above the connector sub 38, the inner mandrel 54 includes a relatively large outside diameter head 62 defining a downwardly facing annular shoulder 64. The annular shoulder 64 interferes with the upwardly facing annular shoulder 46 of the connector sub 38, thereby limiting relative downward movement of the inner mandrel 54.

An annular slip cone 56 is mounted on the outside cylindrical surface of the inner mandrel 54. The cone 56 is retained on the inner mandrel 54 by the bottom sub 60, which is threadably secured at 66 to the lower end of the inner mandrel 54 and secured by a set screw. The guide ring 58 is threadably secured to the outside surface of the cone 56 and secured by a set screw, to provide a means for centering the no-blow tool 10 within the well casing 67, as it is run into the well.

The cone 56 includes circumferentially spaced slots 70 having an upwardly and inwardly tapering conical camming surface 68. A plurality of slips 52 are respectively slidably mounted in slots 70 by a tongue and groove 71. Each slip 52 includes an outer serrated surface 72 for gripping engagement with the inside cylindrical surface of the casing 67.

The slips 52 are retained within the slots 51 formed through the slip ring 40 by the tongue and grooves 71. When the cone 56 moves upperwardly relative to the slip ring 40, the conical camming surface 68 moves relative to the slips, thereby camming the slips 52 radially outwardly into gripping engagement with the inside surface of the casing 67. During run in of the no-blow tool 10, this camming movement is normally prevented by a single shear pin 76 which extends radially through the slip ring 40 to the cone 56.

When retrieving a separation sleeve, or other flow control device without a pressure equalization feature, the no-blow tool 10 described is run into the well as part of the wire line operated assembly of tools. The tools above the no-blow tool 10, threadably connected to the top sub 12, typically include mechanical jars. Below the no-blow tool 10, a conventional wire line pulling tool is threadably secured to the bottom sub 60. In the running configuration of the no-blow tool 10 illustrated in FIGS. 1A and 1B the shear pins 36 engage either the upper annular groove 38 or the lower annular groove 39 of the hammer 22. Hence, the release mandrel 16 is at or near a maximum extension out of the outer annual housing 23. The inner mandrel 54 is at a maximum downward extension relative to the outer housing 23, and is held in place by the shear pin 76. The slips 52 are in a radially retracted position.

When the pulling tool engages the device to be retrieved, the shear pin 76 is sheared by light downward jarring on the no-blow tool. The jarring blows are transmitted through the top sub 12, the release mandrel 16, the shear pins 36, the upper housing 21, the connecting sub 38, the slip ring 40, and through the shear pin 76 to the inner mandrel 54. To assure that the shear pins 36 can transmit sufficient force to shear the pin 76, the shear pins 36 are preferably made of annealed steel, while the pin 76 is preferably formed of brass.

Figure 2A:
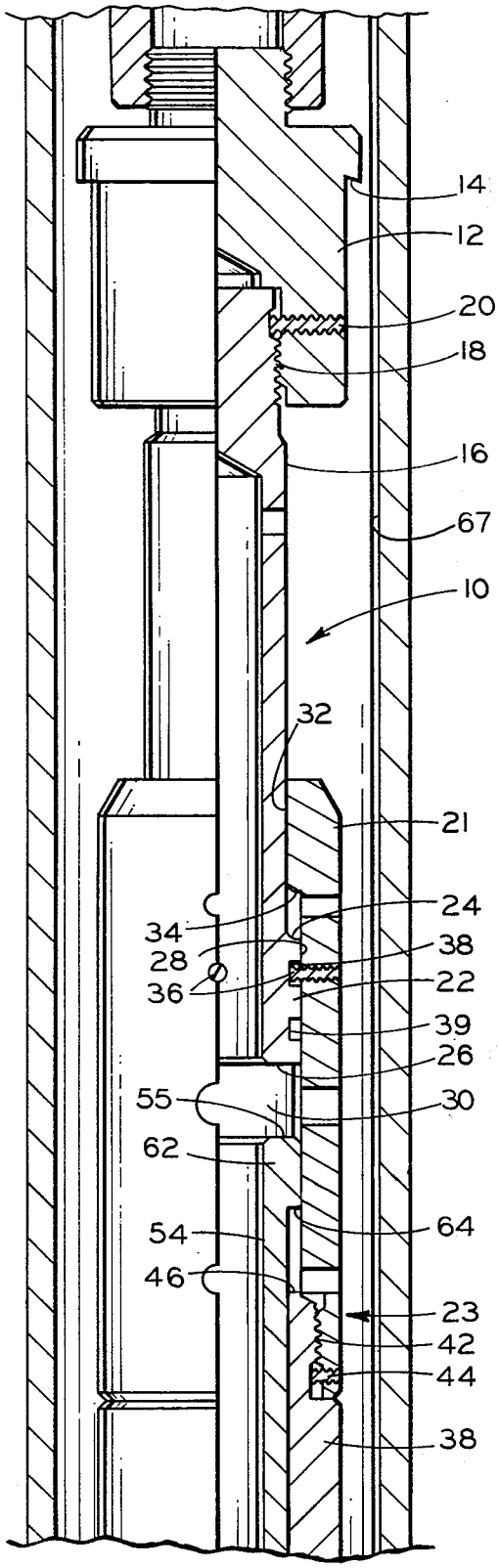
FIGS. 2A and 2B collectively constitute an elevational view in half section of the no-blow tool, illustrated in the anchored or set position.
Figure 2B:
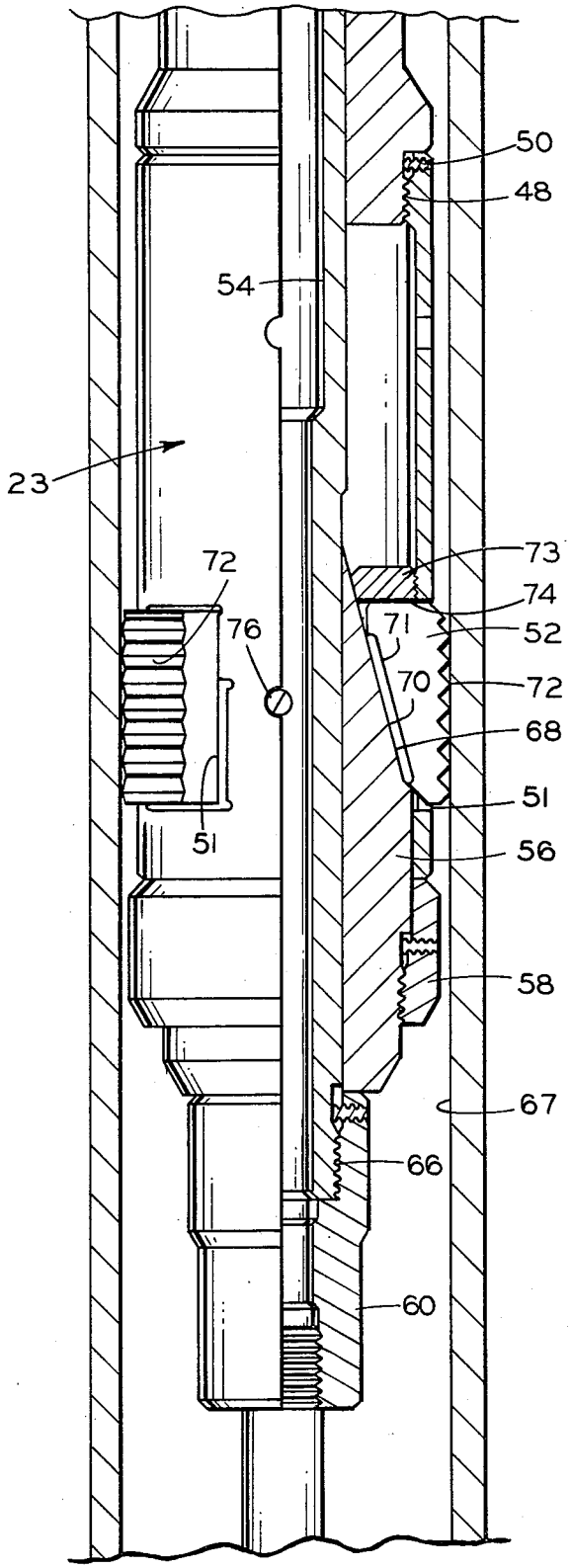

Once the pin 76 is sheared, the slips 52 are free to be cammed outwardly in response to upward movement of the cone 56 relative to the slip ring 40. If there exists higher pressure below the flow control device being retrieved, the device would tend to be blown upwardly as the retrieving tool below the no-blow tool 10 removed it from the seal bore. However, with no-blow tool 10 in place, the initial upward movement of the telescoping member comprising the bottom sub 60, inner mandrel 54, and cone 56 is used to cam the serrated slips 52 into gripping engagement with the inside surface of the casing 67, as illustrated in FIGS. 2A and 2B. Upward movement of the pulling tool and flow control device is effectively prevented by the engagement of the serrated slip surfaces 72 with the casing 67, while pressure around the flow control device is equalized.

After the pressure has equalized, light upward jarring will free the slips 52 from engagement with the casing 67, permitting retrieval of the no-blow tool 10 together with the associated wire line assembly. As the wire line string, including the retrieving tool and the device being retrieved, is pulled upwardly, the no-blow tool 10 will again assume the configuration illustrated in FIGS. 1A and 1B.

In some operations the pulling tool for some reason cannot remove the separation sleeve or other flow control device to be retrieved, and it is desired to release the pulling tool and remove the wire line string. The no-blow tool 10 can transmit the downward jarring forces necessary to release the pulling tool, without interference from slips 52. As illustrated in FIGS. 2A and 2B, the slips 52 are set against the casing 67, and the inner mandrel 54 and the cone 56 are axially fixed by the pulling tool and the flow control device stuck in the seal bore below. Initial downward jarring will be transmitted through the release mandrel 16, the shear pins 36, the connector sub 38, the slip ring 40, and to the slips 52 and casing 67. Sufficient downward jarring will shear the relatively high strength shear pins 36. Thereupon, the release mandrel can be moved downwardly, bringing the lower face 26 of the hammer 22 into contact with the upper annular surface 55 of the inner mandrel 54. Thereafter, downward jarring can be transmitted directly through the release mandrel 16, the inner mandrel 54, and the bottom sub 60 to the pulling tool, without interference from the slip system. Continued downward jarring will release the pulling tool, and permit the retrieval of the entire wire line tool assembly.

Figure 1B:
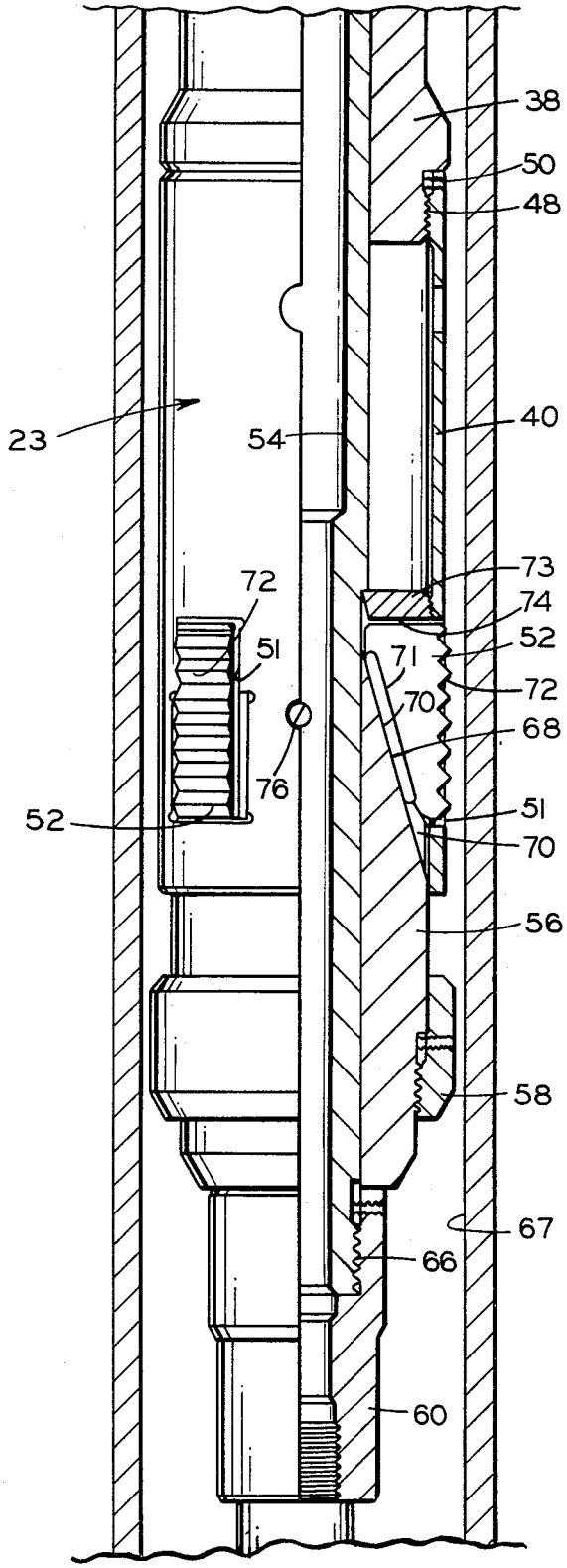

If the no-blow tool 10 is assembled with the shear pins 36 engaging the lower annular groove 39 of the hammer 22, the upper annular face 24 of the hammer 22 abuts the downwardly facing shoulder 34 of the upper housing 21. Therefore, the pins 36 can be sheared, and the release mandrel 16 released, only by downward jarring. Alternatively, if the tool is assembled with the shear pins 36 engaging the upper annular groove 38, the pins can be sheared by upward jarring. Referring to FIGS. 1A and 1B, initial upward jarring would be transmitted to the release mandrel 16, the shear 36, the upper housing 21, the connector sub 38, the upwardly facing shoulder 46 of the connector sub 38, the downwardly facing shoulder 64 of the inner mandrel, to the bottom sub 60 and the stuck pulling tool. Jarring forces of sufficient magnitude will shear the pins 36, permitting the release mandrel 16 and hammer 22 to shift downwardly to deliver jarring blows to the inner mandrel 54, again without interference from the slip system.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A work string element for use in a subterranean well for gripping a well conduit in response to rapid axial movement of the portion of the work string depending from the element comprising: a plurality of relatively axially shiftable members including upper and lower inner members and a surrounding annular housing; upper connection means for securing the upper inner member to a wire line string; lower connection means for securing the lower inner member to a depending tool; means in said annular housing for limiting relative axial movements of both said inner members relative to said annular housing; whereby said lower inner member moves upwardly with respect to said annular housing through a limited axial stroke; radially shiftable slip means on said annular housing for gripping the well conduit when expanded outwardly; an upwardly facing surface on said inner member; a tubular slip actuating member slidably surrounding said lower inner member; said tubular slip actuating member having a downwardly facing surface abuttable with said upwardly facing surface, whereby upward movement of said inner member moves said tubular slip actuating member upwardly to shift said slip means outwardly into engagement with the conduit in response to upward axial movement of said lower inner member, said inner members being abuttable within said housing to transmit downward jarring forces without moving said tubular slip actuating member; and shearable means between said annular housing and said upper inner member for preventing abutting contact of said upper and lower inner members.

2. The tool defined in claim 1 wherein only said shearable means prevents initial axial movement of the other of said inner member in either direction relative to said annular housing, permitting shearing of said shearable means by either upward or downward movement of said upper inner member relative to said annular housing.

3. The tool defined in claim 1 wherein only said shearable means prevents initial downward movement of said upper inner member relative to said annular housing, and said means in said housing for limiting relative axial movement of said inner members prevents initial upward movement of said upper inner member relative to said housing, whereby said shearable means can be sheared only by downward movement of said upper member relative to said housing.

4. A tool for use in a subterranean well for gripping a well conduit in response to rapid upward movement of a lower portion of the tool, comprising an annular housing; an upper release mandrel having its lower end telescopingly mounted within said housing and axially movable to a limited extent relative to said housing; a lower member having its upper end telescopingly mounted within said housing and axially movable to a limited extent relative to said housing; means on said upper release mandrel for attachment to a wire line; means on said lower telescoping member for attachment to a depending tool; radially shiftable serrated slips for gripping the well conduit operatively mounted between said lower telescoping member and said housing; an upwardly facing annular shoulder on said lower member; a tubular slip actuating member surrounding said lower member; said tubular slip actuating member having an upwardly and inwardly inclined conical surface for engaging said slips upon upward movement relative thereto; said tubular slip actuating member further having a downwardly facing surface abuttable with said upwardly facing surface on said lower member, whereby upward movement of said lower member moves said tubular slip actuating member upwardly to radially, outwardly expand said slips into engagement with said conduit; said slips being radially retractable in response to downward movement of said tubular slip actuating member relative to said housing; the lower end of said upper release mandrel being axially shiftable into abutment with said lower member within said housing after expansion of said slips, whereby jarring forces can be transmitted without dislodging said slips; and shearable means fixing said upper mandrel relative to said housing to prevent downward movement of said upper mandrel member into abutment with said lower member.

5. The tool defined in claim 4 wherein only said shearable means prevents initial axial movement of said release mandrel in either an upward or downward direction relative to said housing, whereby said shearable means can be sheared by either upward or downward movement of said release mandrel relative to said housing.

* * * * *